United States Patent [19]

DePaolo, Sr.

[11] Patent Number: 4,567,680

[45] Date of Patent: Feb. 4, 1986

[54] PERMA DESK CALENDAR

[76] Inventor: Frank DePaolo, Sr., 839 Terrace Ave., Daytona Beach, Fla. 32014

[21] Appl. No.: 572,886

[22] Filed: Jan. 23, 1984

[51] Int. Cl.[4] ..... G09D 3/10

[52] U.S. Cl. ..... 40/109

[58] Field of Search ..... 40/109, 107

[56] References Cited

U.S. PATENT DOCUMENTS

| | | | |
|---|---|---|---|
| 476,263 | 6/1892 | Guidinger | 40/109 |
| 1,541,151 | 6/1925 | Khalifah | 40/109 |
| 1,785,640 | 12/1930 | McNamara | 40/109 |

FOREIGN PATENT DOCUMENTS

| | | | |
|---|---|---|---|
| 2648312 | 4/1978 | Fed. Rep. of Germany | 40/109 |

*Primary Examiner*—Gene Mancene
*Assistant Examiner*—Cary E. Stone

[57] ABSTRACT

This invention is a perpetual desk calendar, including a base on which to stand, a hollow case on the base, windows on the front of the case for seeing selected indicia printed on movable slides inside the case; the indicia indicating a year number, a month of the year and the date of the month.

5 Claims, 11 Drawing Figures

Fig. 1
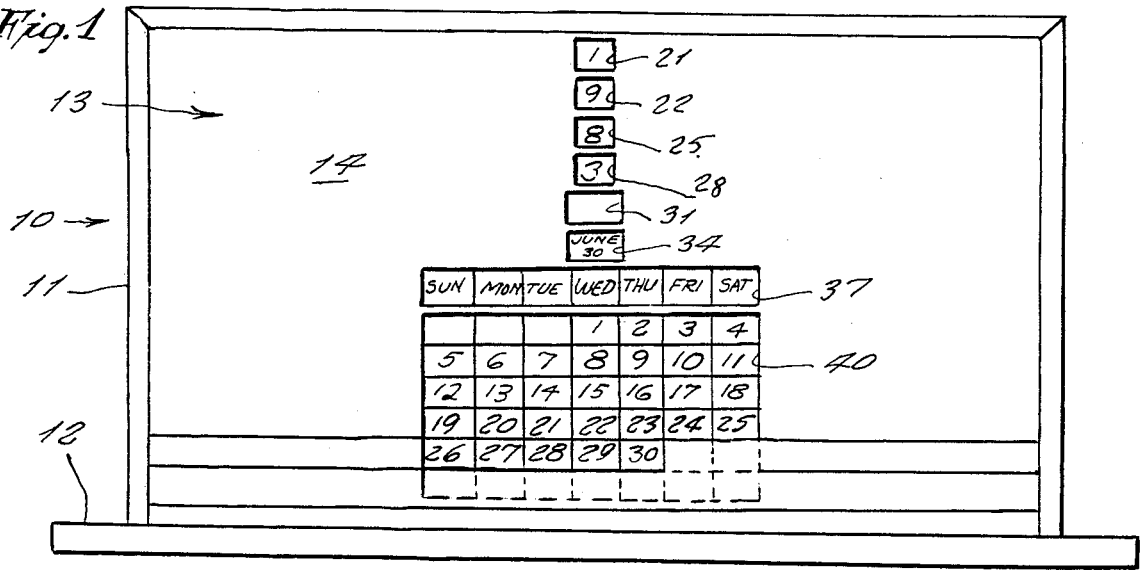
Fig. 2
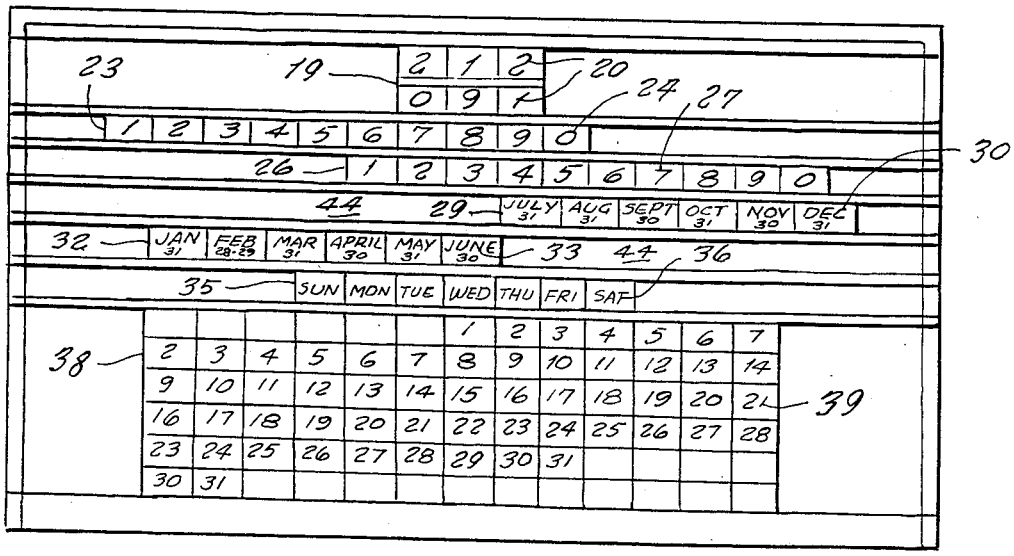
Fig. 3
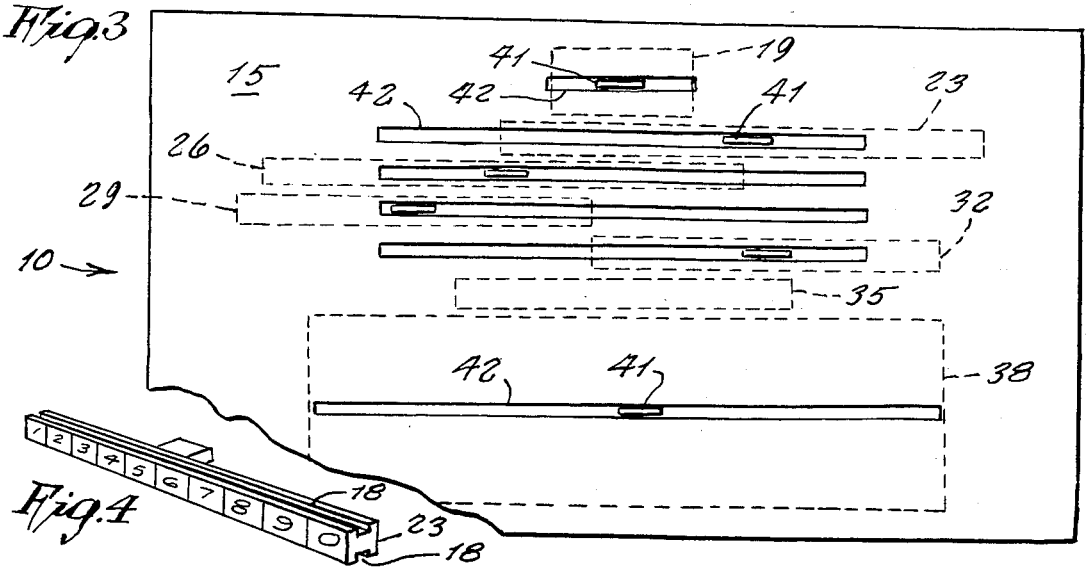
Fig. 4

Fig. 5
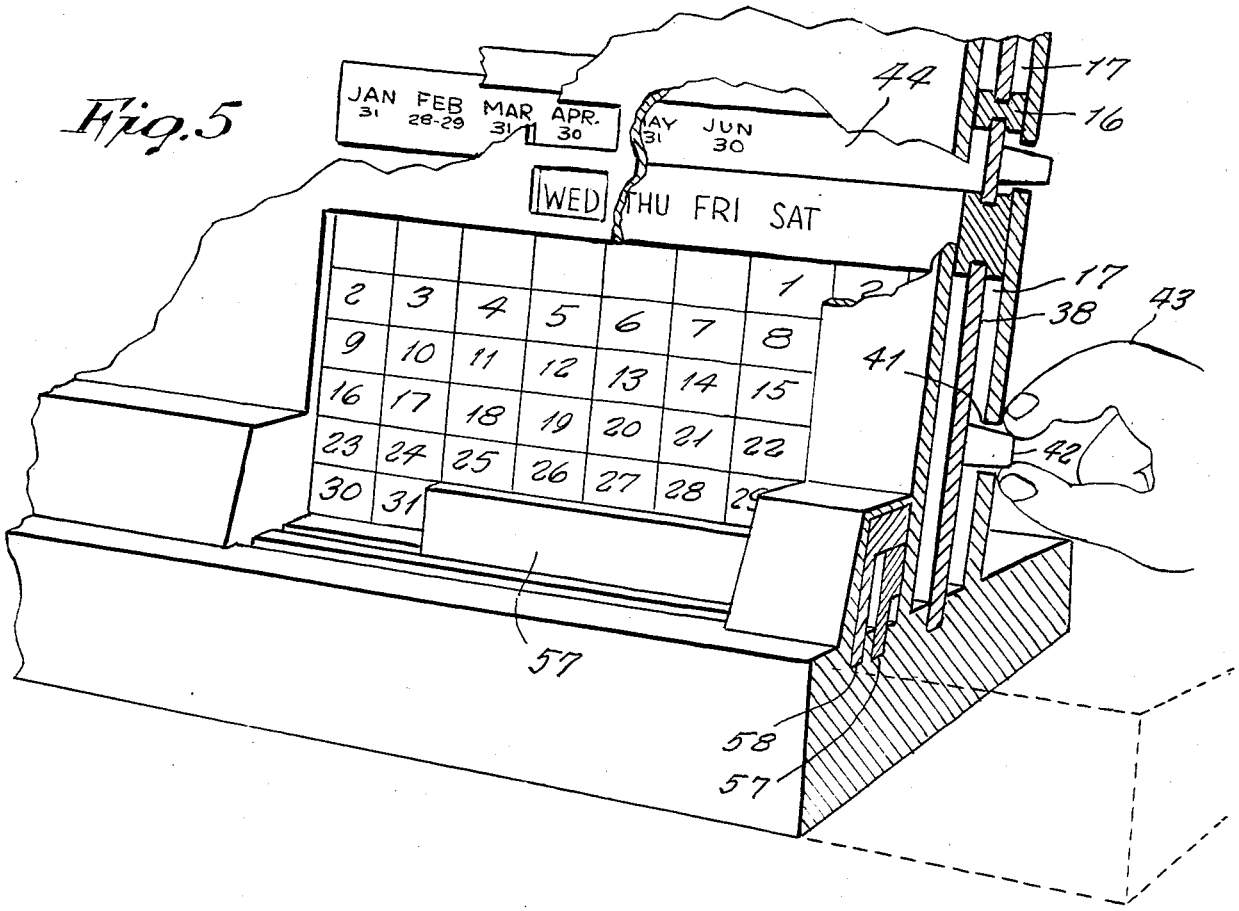
Fig. 6
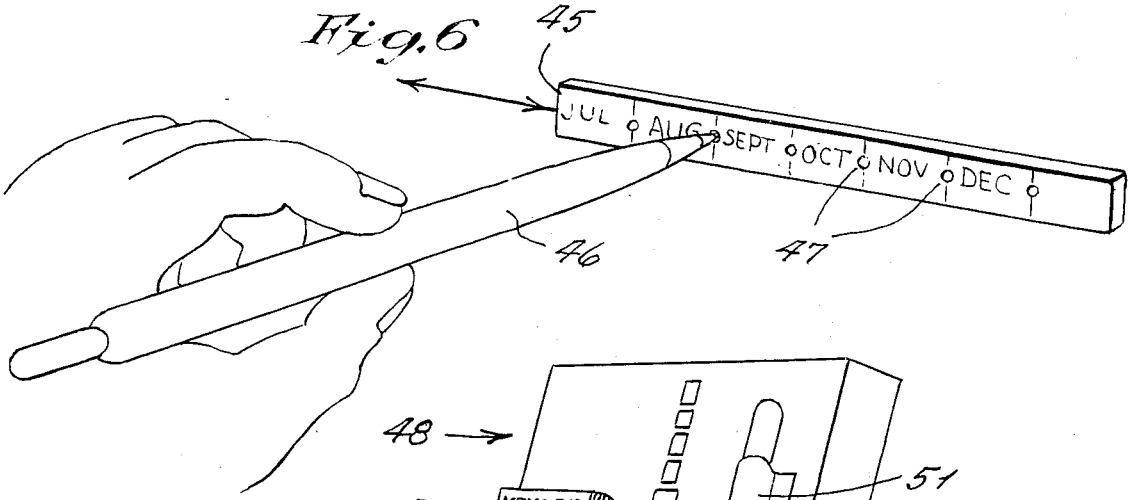
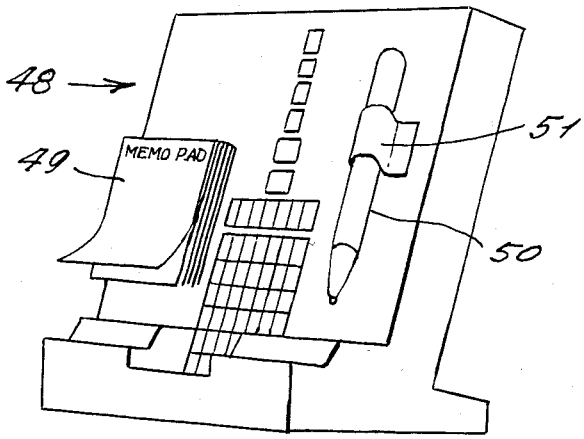
Fig. 7

Fig. 8
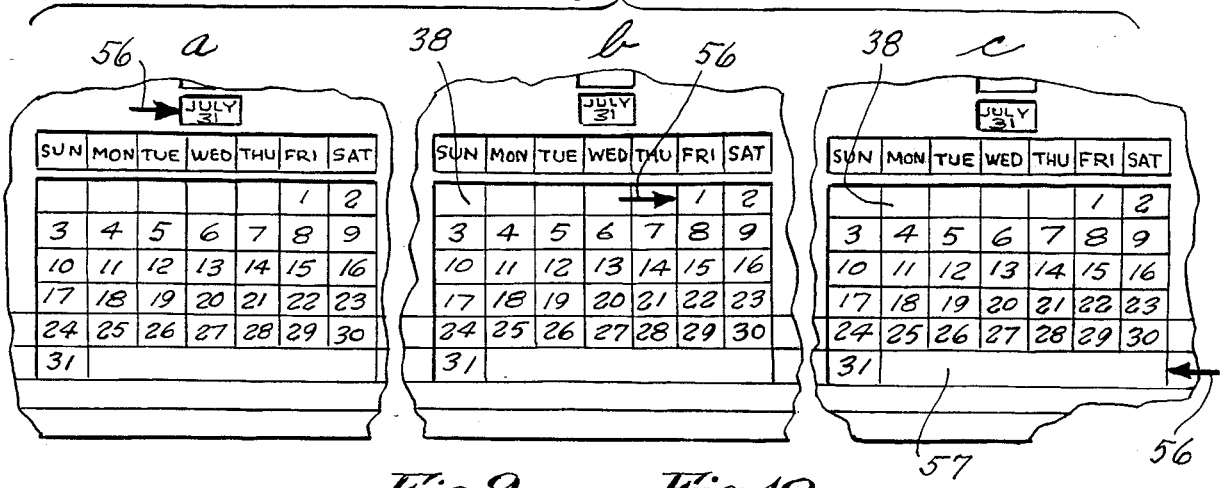
Fig. 9
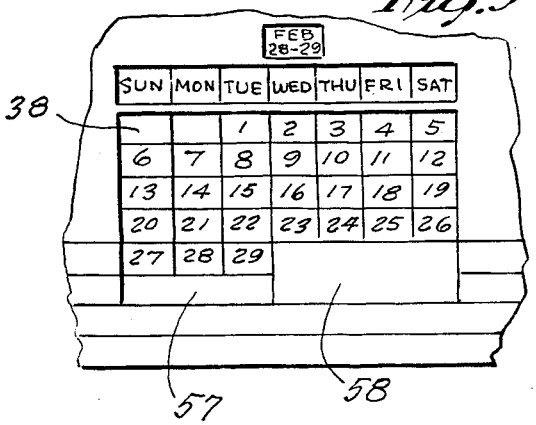
Fig. 10
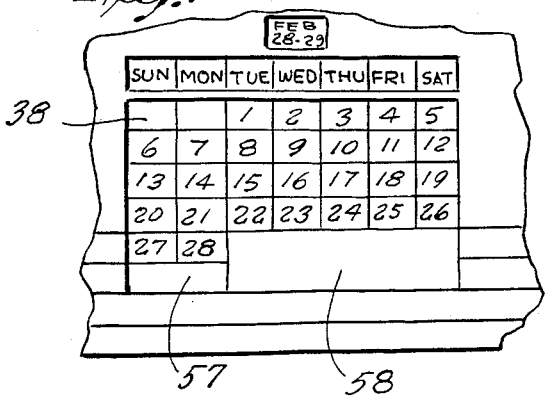
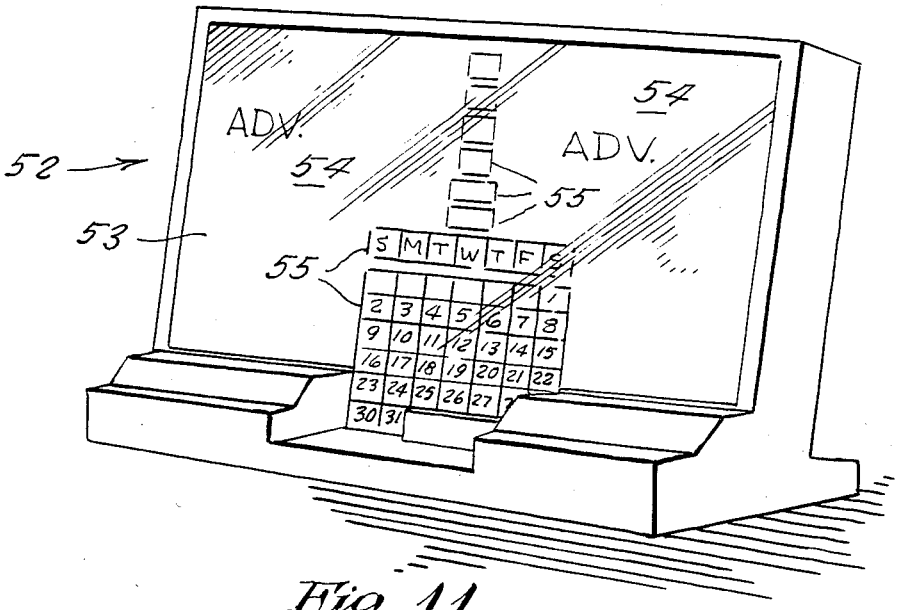
Fig. 11

PERMA DESK CALENDAR

BACKGROUND OF THE INVENTION

This invention relates generally to perpetual calendars, such as do not get out of date for many years, thus differing from conventional calendars, that are discarded every year.

While perpetual calendars have been designed in the past, none of them, to the applicant's knowledge, has a conventional calendar display face, so that they can be read only by persons who must first learn how to read them, whereby such a perpetual calendar is not ideally suitable for display on a desk, table or shelf, where many diverse individuals may need to refer to a calendar.

Accordingly, it is a principal object of the present invention to provide a perpetual calendar, that is especially suited for display upon a desk, by being easily readable by anyone acquainted with a conventional calendar.

Another object is to provide a perma desk calendar, which may be usable for several centuries of time, without becoming obsolete.

Yet another object is to provide a perma desk calendar, which can be quickly and easily reset for changing a date.

Yet a further object is to provide a perma desk calendar, which, in one design thereof, includes advertising space, so that it is suitable as a premium gift.

Yet a further object is to provide a perma desk calendar, which in another design thereof, includes a handy memo pad and writing implement for jotting down conveniently a reminder note, a telephone number or the like.

Other objects are to provide a perma desk calendar, which is simple in design, inexpensive to manufacture, rugged in construction, easy to use, and efficient in operation.

BRIEF DESCRIPTION OF THE DRAWING

These, and other objects, will be readily evident, upon a study of the following specification, and the accompanying drawing, wherein:

FIG. 1 is a front elevational view of the invention;

FIG. 2 is a front elevational view thereof, shown with the front cover plate having been removed;

FIG. 3 is a rear elevational view thereof;

FIG. 4 is a front perspective view of one of the slides, and showing a typical construction thereof;

FIG. 5 is an enlarged fragmentary front perspective view thereof, shown partly in cross-section;

FIG. 6 is a front perspective view of another design of slide, which, instead of push handle on its rear, is slid by a pen or pencil engaging a hole on its front side;

FIG. 7 is a front perspective view of another design of the invention, which includes a memo pad and pen stored on its front side;

FIG. 8 illustrates the sequence of steps for changing a date on the calendar;

FIG. 9 is a front elevation view of the calendar set for the month of February;

FIG. 10 is a similar view thereof, set for a leap year, and

FIG. 11 is a front perspective view of yet another design of the invention, shown including a glass front panel having advertising space thereupon.

DESCRIPTION OF THE PREFERRED EMBODIMENT

Referring now to the drawings in greater detail, and more particularly to FIGS. 1 to 5 thereof, at this time, the reference numeral 10 represents a perma desk calendar, according to the present invention, wherein there is a hollow case 11 mounted upon a broad base 12, adaptable for placement upon a desk or the like. As shown in FIG. 5, the case is made slightly rearwardly tilted for easier visibility of a front display panel 13 thereof. The case is made preferably of wood, and includes spaced-apart front and rear walls 14 and 15, having a plurality of horizontal ribs 16 either formed or rigidly secured therebetween, in order to form spaces 17 between the ribs, so that a slide is horizontally slidable within each one of the spaces. Grooves 18 are provided along the ribs, in order that the edges of the slides fit therein for easy sliding movement. Each of the slides has different indicia imprinted on its front side, and a portion of this indicia is selectively made visible in a narrower window opening through the front wall, when a person looks at the front display panel.

An uppermost slide 19 has two horizontal rows of numerals 20 imprinted thereon, and one of the numerals in each row is visible in the two window openings 21 and 22 of the front wall. A next slide 23 below the slide 19 is printed with numerals "1" to "0" as indicated at 24, and which are selectively visible in a window opening 25. A next slide 26 is likewise printed with numerals "1" to "0" as indicated at 27, and which are selectively visible in a window opening 28. A next slide 29 therebelow is imprinted with the names of the last six months of the year, as shown at 30, and each month indicating the number of days therein, for visibility in window 31. A next slide 32 therebelow is similarly printed as shown at 33, but showing only the first six months of the year for visibility in window 34. The numeral 44 represents the slots within which the slides 29 and 32 are positioned. A stationary, non-sliding panel 35 is printed with the names of the days of the week, as shown at 36, and is fully seen in long window opening 37. A lowermost slide 38 therebelow is printed with monthly date numerals 39, that are selectively visible in window opening 40.

Each of these slides may be manually shifted toward the left or right, in order that the desired printed data appears in the window. Accordingly, a knob 41 on the rear of each slide protrudes outward of a slot 42 on the rear of the case, for being grasped by a person's hand 43. Shifting of slides 19, 23, and 26 allows the display or any year number in the twentieth, twenty-first or twenty-second century. Slides 29 and 32 are shifted, so that in one window 31 or 34, a month name of one of the slides appears in the other window. All the days of the week are visible at all times in the window 37. The window 40 is the same length as window 37, so that any adjacent seven vertical rows of numbers 39 are visible in the window.

Thus, in reading the calendar, the year is indicated at the top, the month below this, and then the days of the week at the top of the seven vertical rows of dates of a month.

It is to be noted that the non-sliding panel 35, accordingly, has no knob 41, and there is no slot 42 for it, either. The panel may be made integral with the ribs 16 adjacently thereabove and therebelow, as shown in FIG. 5.

FIG. 6 illustrates a modified design of slide 45, which needs no knob 41 or slot 42, because it is shifted, as wished, by means of a pen or other pointed implement 46 being inserted through the front window opening and into any one of small depressions 47 of the slide which appears within the window.

FIG. 7 illustrates a modified design of perma desk calendar 48, which includes a handy memo pad 49, and removable pen 50 from a pen holder 51 mounted on the front side of the case.

FIG. 11 illustrates another design of perma desk calendar 52, which additionally includes a glass front wall 53 on its case, having spaces 54 for the purpose of displaying advertising messages. The rest of the case may be made of opaque plastic, and, if preferred by a manufacturer, the glass front wall may actually comprise a transparent sheet of plastic that is paint-sprayed on its inner side, leaving unsprayed portions 55, that serve as clear windows through which to see.

In FIG. 8, successive steps are shown by arrows 56 for resetting the calendar. At step a, the month name is adjusted. At step b, the slide 38, having the days of the month, is adJusted so that the days commence from a desired specific day of the week. At step c, a low block 57 is slid inside the base of the case, for covering up or exposing the date numerals on the sixth line of the slide 38, depending upon whether a displayed month has thirty or thirty-one days. As shown more clearly in FIG. 5, the block 57 slides in front of the slide 38.

In FIGS. 9 and 10, a higher block 58 is shown, that is slidable in front of the low block 57, in order to cover up unwanted numerals in the fifth line of the slide 38 when the exposed month is February. FIG. 9 shows the block 58 in position for a leap year, and FIG. 10 shows it in position for the other three years.

While various changes may be made in the detail construction, it is understood that such changes will be within the spirit and scope of the present invention, as is defined by the appended claims.

What I claim as new, is:

1. The perpetual calendar comprising:

a substantially flat rectangular shaped base member;

front and rear spaced wall members attached to an upper surface of said member and projecting upwardly therefrom;

a plurality of spaced rib members positioned between said wall members and aligned horizontally in a plane parallel to said upper surface of said base member, said rib members defining slots between said wall members;

a plurality of windows form in said front wall member, said windows being aligned with corresponding ones of said slots;

a plurality of horizontal slits form in said rear wall member, each of said slits being aligned with corresponding ones of said slots;

a first slide adapted to fit in an uppermost one of said slots and having a rearwardly projecting knob extending through the corresponding one of said slits, said first slide having numbers on a front face thereof with said numbers being arranged in multiple columns of two rows in length whereby two of said numbers appear in the uppermost ones of said windows;

a second slide adapted to fit in a slot immediately below said uppermost slot and having a rearwardly projecting knob extending through the corresponding one of said slits, said second slide having numbers on a front face thereof and being arranged whereby two of said numbers appear in the one of said windows below said uppermost windows;

a third slide adapted to fit in a third one of said slots, said third slide having printed on a front face thereof in sequential manner in a horizontal direction the names of the first six months of the year, said third slide having a knob member protruding from a rear portion thereof and extending through the corresponding one of said slits whereby said third slide may be moved to position the name of one of said six months within the corresponding one of said windows;

a fourth slide positioned in a fourth one of said slots and having printed thereon the names of the last six months of the year in a sequential manner along a horizontal direction of said fourth slide, said fourth slide having a knob protruding through a corresponding one of said slits whereby said fourth slide may be moved horizontally to position the name of an appropriate one of said months within the corresponding one of said windows;

a fifth fixed member having printed on a face thereof the name of the seven days of the week, the week day names all appearing simultaneously in an elongated window positioned horizontally below the fourth one of said windows;

a sixth slide comprising a plurality of numbered squares arranged in a calendar format and forming an array of six rows and thirteen columns, said sixth window having a dimension sufficient to accomodate six rows by seven columns of said sixth slide at any one time, said sixth slide having a knob protruding through a corresponding one of said slits whereby said slide member can be moved horizontally to position appropriate numerals corresponding to the days of the week associated with a particular named day as a function of the particular month and corresponding year for which the calendar is set, and wherein said slide members have a horizontal dimension sufficiently less than the width of said front wall member whereby said slide members do not protrude in any position from the ends of said calendar.

2. The calendar as set forth in claim 1 wherein each of said rib members includes grooves within which said slide members are guided.

3. The calendar as set forth in claim 1 wherein said first slide member includes numbers arranged in three columns.

4. The calendar as set forth in claim 1 wherein said second slide member is divided into two sections each independently moveable and having numerals on each section arranged horizontally from 0 to 9.

5. The calendar as defined in claim 1 and including space on the front of said front wall member outside of said windows for mounting a memo pad.

* * * * *